United States Patent [19]

Malagari, Jr.

[11] 4,337,101

[45] Jun. 29, 1982

[54] PROCESSING FOR CUBE-ON-EDGE ORIENTED SILICON STEEL

[75] Inventor: Frank A. Malagari, Jr., Freeport, Pa.

[73] Assignee: Allegheny Ludlum Steel Corporation, Pittsburgh, Pa.

[21] Appl. No.: 179,405

[22] Filed: Aug. 18, 1980

[51] Int. Cl.[3] ..... H01F 1/04

[52] U.S. Cl. ..... 148/111; 148/31.5; 148/113

[58] Field of Search ..... 148/110, 111, 112, 113, 148/31.5

[56] References Cited

U.S. PATENT DOCUMENTS 3,873,381 3/1975 Jackson ..... 148/112

4,000,015 12/1976 Malagari ..... 148/112

*Primary Examiner*—John P. Sheehan

*Attorney, Agent, or Firm*—Patrick J. Viccaro; Vincent G. Gioia

[57] ABSTRACT

A process for producing electromagnetic silicon steel having a cube-on-edge orientation and a permeability of at least 1800 ($G/O_e$) at 10 oersteds. The process includes the steps of preparing a melt of silicon steel containing from 0.02% to 0.06% carbon, from 0.0006% to 0.008% boron, up to 0.01% nitrogen, up to 0.008% aluminum and from 2.5% to 4.0% silicon, casting the steel, hot rolling the steel to hot band gage, annealing the hot band in a temperature range of from 1450°-1650° F., cold rolling the steel to a final gage of about 0.018 inch in one cold reduction, decarburizing the steel, applying a refractory oxide base coating to the steel and texture annealing the steel.

5 Claims, 2 Drawing Figures

PROCESSING FOR CUBE-ON-EDGE ORIENTED SILICON STEEL

Figure 2:
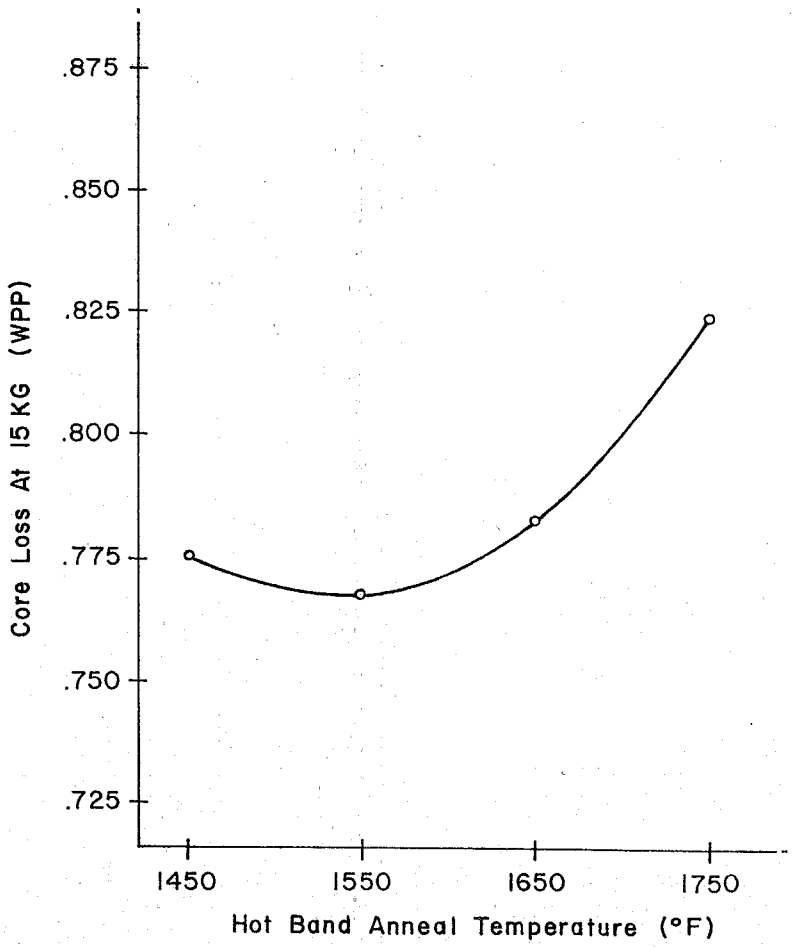

The present invention relates to an improvement in the manufacture of grain-oriented silicon steel.

Silicon steel having a cube-on-edge grain orientation has desirable magnetic properties, particularly high permeability. Thus, silicon steel is commercially useful in electrical equipment such as motors, generators, transformers and similar products. To reduce eddy current losses and heat problems created by alternating electrical current, current-carrying stators, transformer cores and the like are formed from laminations of thin strips of silicon steel, rather than from one piece of steel. Accordingly, the electrical industry has called upon the silicon steel manufacturers to provide high magnetic quality silicon steel strip at thicknesses of from 0.010 to 0.014 inches and the manufacturers have developed practices to produce acceptable strip. The processing steps are well known in the art and extensively discussed in the trade and patent literature. U.S. Pat. No. 3,873,381 describes a practice for producing a boron-inhibited silicon steel which includes the steps of preparing a melt containing 0.002%–0.012% boron, 2%–4% silicon, 0.01%–0.15% manganese, 0.02%–0.05% carbon, 0.01%–0.03% sulfur, 0.003%–0.010% nitrogen and up to 0.008% aluminum, casting the melt, reheating the silicon steel at a temperature of from 2300° F. to 2550° F., hot rolling the silicon steel to hot band thicknesses of from 0.050–0.10 inch, annealing the hot band at a temperature of from 1500° F. to 2100° F. and preferably from 1700° F. to 2000° F., cold rolling in one step (or in several steps with intermediate anneals) to a final gage of from 0.010 inch to 0.014 inch, decarburizing the steel, applying a refractory oxide base coating to the steel and final texture annealing the steel. Another practice for producing a boron-inhibited silicon steel is described in U.S. Pat. No. 4,000,015 which includes the steps of preparing a melt containing about 0.0010% boron, casting, soaking, hot rolling to hot band gage, annealing at 1650° F., cold rolling to an intermediate gage, annealing, cold rolling to about 0.011 inch, decarburizing the steel and final texture annealing the steel. The silicon steels produced according to these practices have permeability values well in excess of 1800 ($G/O_e$) at 10 oersteds and core losses (at least in the products of the latter practice) of less than 0.700 WPP (watts per pound) at 17 KB.

The electrical manufacturers are urged by the manufacturing cost of forming the laminations of silicon steel strips to use the thickest possible strip in the laminations. Thus, in large applications such as stators for large steam turbines and the like, laminations of steel strips of nominal thicknesses of 0.018 inch are preferred to the commercial 0.010 to 0.014 inch thick strip but the permeability must be at least 1800 ($G/O_e$) at 10 oersteds and the core losses must be less than 0.900 WPP at 15 KG.

The present invention relates to an improved process for producing a boron-inhibited electromagnetic silicon steel having a cube-on-edge orientation and a permeability of at least about 1800 ($G/O_e$) at 10 oersteds at thicknesses of about 0.018 inch. In accordance with the present invention, the process comprises the steps of preparing a melt of silicon steel containing from 0.02% to 0.06% carbon, from 0.0006% to 0.008% boron, up to 0.01% nitrogen, up to 0.008% aluminum and from 2.5% to 4.0% silicon, casting the steel, soaking the steel, and preferably at 2250° F. to 2300° F., hot rolling the steel to a hot band thickness of about 0.10 inch, annealing the steel in a temperature range of from 1450° F. to 1650° F. and preferably from 1450° F. to 1550° F., cold rolling the hot band to a final thickness of about 0.018 inch in one cold reduction, decarburizing the steel, applying a refractory oxide base coating to the steel and texture annealing the steel. Steels processed according to the invention have a core loss of less than 0.900 WPP at 15 KG and thus are particularly useful in the laminations of stators of large steam turbines. Boron inhibited silicon steels processed according to the preferred hot band anneal range of from 1450° F. to 1650° F. (788°–899° C.) embody the optimum magnetic qualities. Also, the process realizes significant energy savings per net ton over conventional processes.

Figure 1:
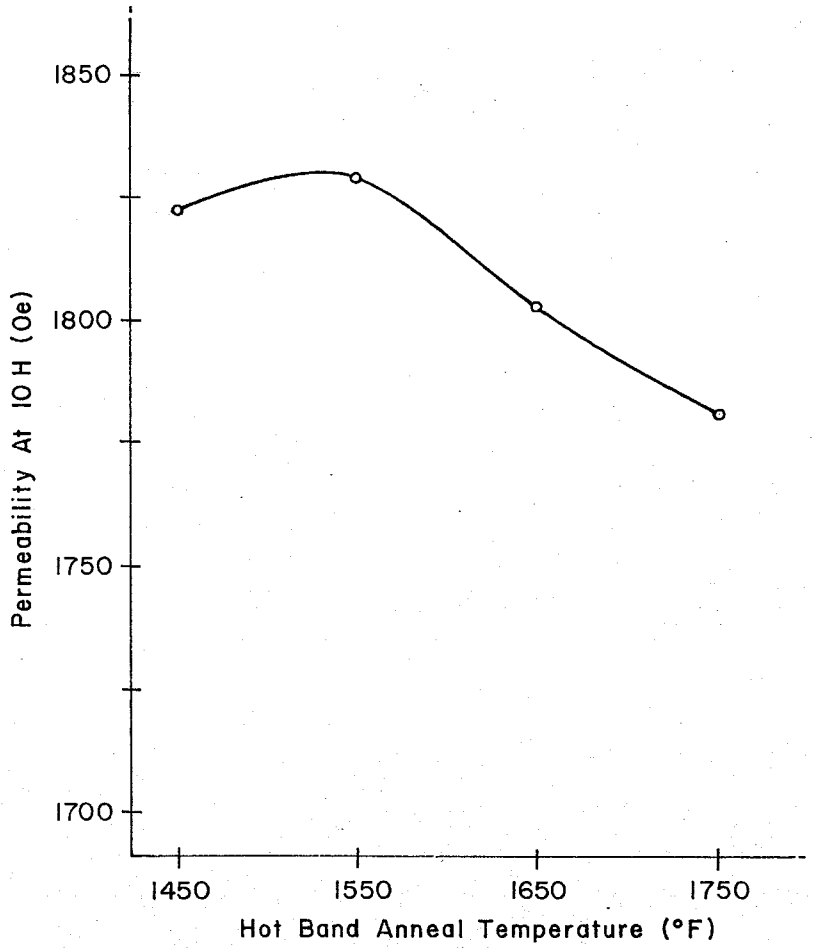

The foregoing and other details, objects and advantages of the invention will be best understood from the following description, reference being had to the accompanying drawings wherein:

FIG. 1 is a graph illustrating the effect of hot band anneal temperature upon the permeability of 0.018 inch boron-inhibited silicon steel processed according to the invention; and FIG. 2 is a graph illustrating the effect of hot band anneal temperature upon the core loss of 0.018 inch boron-inhibited silicon steel processed according to the invention.

Boron-containing silicon production heats were melted, cast, soaked at temperatures of from 2250° F. to 2300° F. and hot rolled to a band thickness of about 0.10 inch. Identical samples were laboratory annealed for one minute at 1450° F., 1550° F., 1650° F. and 1750° F. prior to cold rolling direct from about 0.10 inch to the final thickness of 0.018 inch. The samples then received a decarburization anneal, received a coating consisting of magnesium hydroxide and received a texture anneal. The magnetic properties of the coils are:

| ANNEAL TEMP (°F.) | GAGE (mils) | PERMEABILITY (10 $O_e$) | CORE LOSS (WPP @ 15 KG) |
|---|---|---|---|
| 1450 | 18 | 1822 | .775 |
| 1550 | 18 | 1829 | .766 |
| 1650 | 17.9 | 1803 | .779 |
| 1750 | 17.9 | 1781 | .820 |

FIG. 1 is a plot of the permeability values and FIG. 2 is a plot of the core loss values set forth above. FIGS. 1 and 2 clearly illustrate the increasingly acceptable permeability and core loss characteristics of 0.018 inch silicon steel sheet as the hot band anneal temperature falls below 1650° F. to an annealing range of from 1450° F. to 1550° F. where the optimum magnetic values are obtained.

It will be apparent to those skilled in the art that the novel principles of the invention disclosed herein may be otherwise variously embodied within the scope of the following claims.

What is claimed is:

1. In a process for producing boron-inhibited electromagnetic silicon steel having a cube-on-edge orientation and a permeability of at least 1800 ($G/O_e$) at 10 oersteds, which process comprises the steps of preparing a melt of silicon steel containing from 0.02% to 0.06% carbon, from 0.0006% to 0.008% boron, up to 0.01% nitrogen, no more than 0.008% aluminum and from 2.5% to 4.0% silicon, casting the steel, soaking the steel, hot rolling the steel to hot band thickness, annealing the hot band, cold rolling the annealed steel, decarburizing the cold rolled steel, applying a refractory oxide base coating to the decarburized steel, and final textue annealing the base coated steel, wherein the improvement comprises the steps of annealing the hot band at a thickness of about 0.10 inch in a temperature range of from about 1450° F. to about 1650° F. and then cold rolling the steel to a final thickness of about 0.018 inch in one cold reduction.

2. The improved process of claim 2 wherein the steel is soaked at a temperature of from 2250° F. to 2300° F. before the hot rolling step.

3. The improved process of claim 1 or claim 2 wherein the hot band is annealed in a temperature range of from 1450° F. to 1550° F.

4. The improved process of claim 1 wherein the base coat applied to the decarburized steel consists of magnesium hydroxide.

5. A cube-on-edge oriented silicon steel having a permeability of at least 1800 ($G/O_e$) at 10 oersteds and a core loss of not more than 0.900 WWP at 15 KG and made in accordance with the process of claim 1 or claim 2.

* * * * *

UNITED STATES PATENT AND TRADEMARK OFFICE

CERTIFICATE OF CORRECTION

PATENT NO. : 4,337,101

DATED : June 29, 1982

INVENTOR(S) : Frank A. Malagari, Jr.

It is certified that error appears in the above-identified patent and that said Letters Patent are hereby corrected as shown below:

In claim 2, line 1, cancel "2" and insert -- 1 --.

Signed and Sealed this

*Twelfth* Day of *October 1982*

[SEAL]

*Attest:*

GERALD J. MOSSINGHOFF

*Attesting Officer*

*Commissioner of Patents and Trademarks*